United States Patent [19]

Witthaus

[11] 4,360,856

[45] Nov. 23, 1982

[54] ELECTRIC SENSOR PACKAGE

[76] Inventor: Ira L. Witthaus, 310 E. Walton, Warrenton, Mo. 63383

[21] Appl. No.: 223,415

[22] Filed: Jan. 8, 1981

[51] Int. Cl.[3] ..... H01H 47/32

[52] U.S. Cl. ..... 361/170; 361/178; 340/541

[58] Field of Search ..... 361/170, 178, 179, 191; 340/541, 521, 691

[56] References Cited

U.S. PATENT DOCUMENTS

| | | | |
|---|---|---|---|
| 3,470,551 | 9/1969 | Jaffe | 361/170 X |
| 3,590,335 | 6/1971 | Tetar | 361/178 |
| 3,842,409 | 10/1974 | Mayer | 361/170 |
| 3,848,231 | 11/1974 | Wootton | 340/521 |
| 3,978,479 | 8/1976 | Schmitz | 340/541 |
| 4,001,819 | 1/1977 | Wise | 340/541 |
| 4,092,643 | 5/1978 | Stolarczyk | 340/541 |
| 4,140,006 | 2/1979 | Braxton | 340/541 |
| 4,148,019 | 4/1979 | Durkee | 340/541 |

*Primary Examiner*—G. Z. Rubinson
*Assistant Examiner*—L. C. Schroeder
*Attorney, Agent, or Firm*—Polster, Polster and Lucchesi

[57] ABSTRACT

An electronic sensor package includes at least six sensor-amplifier circuits each adapted to be electrically connected to a different condition-responsive device and each electrically connected directly to a relay for energizing the relay, each of the relays being electrically connected to at least two of the sensor-amplifier circuits, whereby the number of relays to which the sensor amplifier circuits are connected is no more than half the number of sensor-amplifier circuits. The relays are electrically connected to a timing circuit electrically connected to signalling or controlling devices.

5 Claims, 15 Drawing Figures

FRONT PANEL

REAR PANEL

BACK

ELECTRIC SENSOR PACKAGE

BACKGROUND OF THE INVENTION

Multiple sensing circuits combining fire detection and intrusion detection circuits, for example, are well known. Examples in the patent literature include U.S. patents to Rowe et al., U.S. Pat. Nos. 2,640,975, Hoey, 3,150,359, Midkiff, 3,487,404, Hough, 3,603,973, Benedict, 3,678,511, Judlowe, 3,686,654, Durkee, 3,686,668, Schubert, 3,810,171, Schmitz et al., 3,990,075 and Wise, 4,001,819.

The devices of the prior art have been either limited in the numbers of sensing functions they could perform, or extremely complicated, or both.

One of the objects of this invention is to provide an electronic sensor package which provide options for at least six different sensor functions in a compact package, that is economical to produce, rugged and reliable.

Other objects will become apparent to those skilled in the art in the light of the following description and accompanying drawing.

SUMMARY OF THE INVENTION

In accordance with this invention, generally stated, an electronic sensor package is provided that contains at least six sensor-amplifier circuits each adapted to be electrically connected to a different condition responsive device. Each of the circuits is electrically connected directly to a relay for energizing the relay. Each of the relays is electrically connected to at least two of the sensor-amplifier circuits, so that the number of relays to which the sensor-amplifier circuits are connected directly is no more than half the number of sensor-amplifier circuits. The relays are electrically connected to a timing circuit that in turn is electrically connected to signal means or control devices. The conditioned responsive devices are preferably taken from among a gas sensor, a proximity type intrusion detector, a switch type intrusion detector, a sound sensor, a photosensitive fire detector, an ionization type smoke detector, a weather detector, and external timing and switching devices.

DESCRIPTION OF PREFERRED EMBODIMENT

Figure 1:
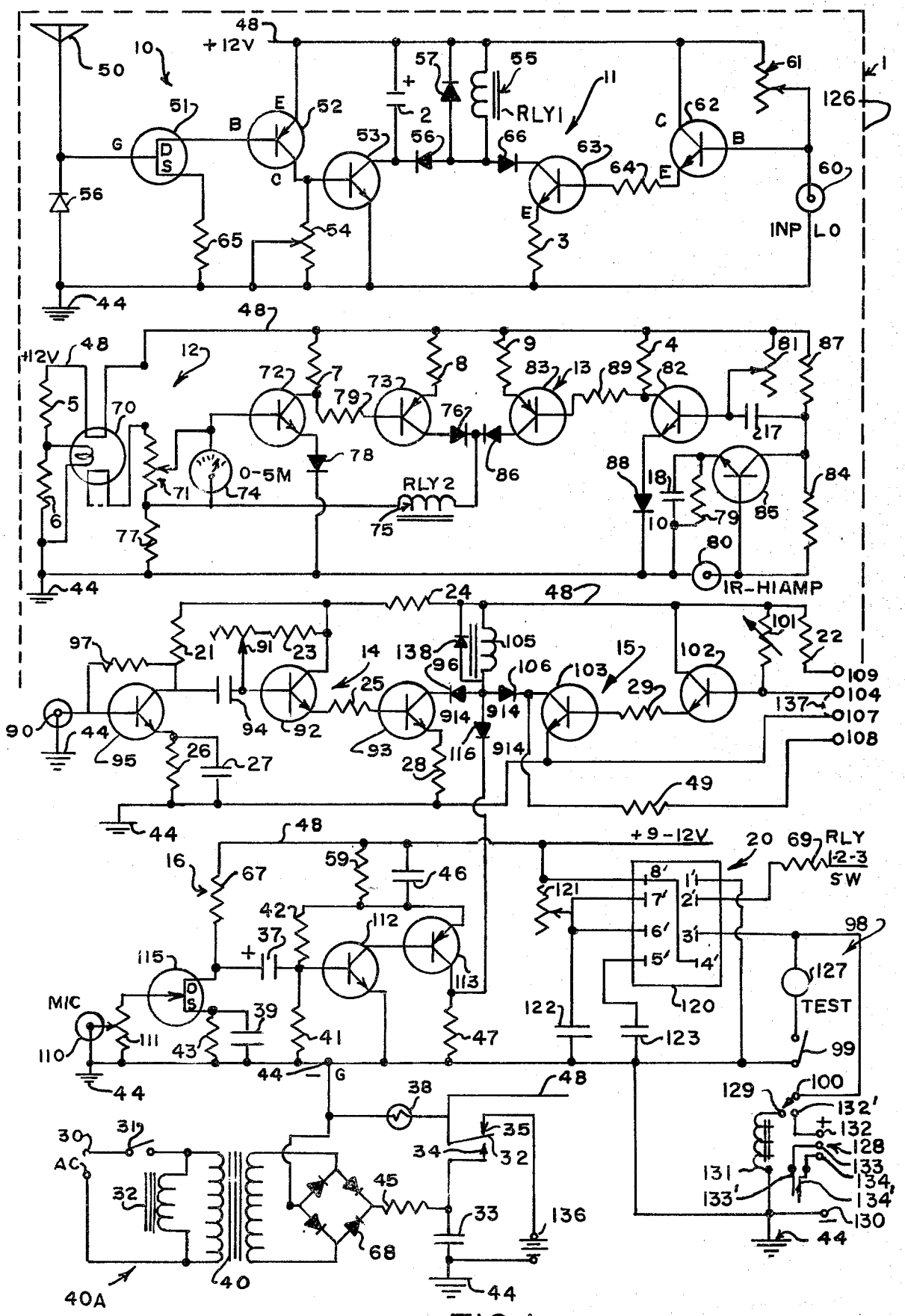
FIG. 1 is a schematic view illustrating particularly the electric circuitry of one illustrative embodiment of sensor package of this invention.
Figure 2:
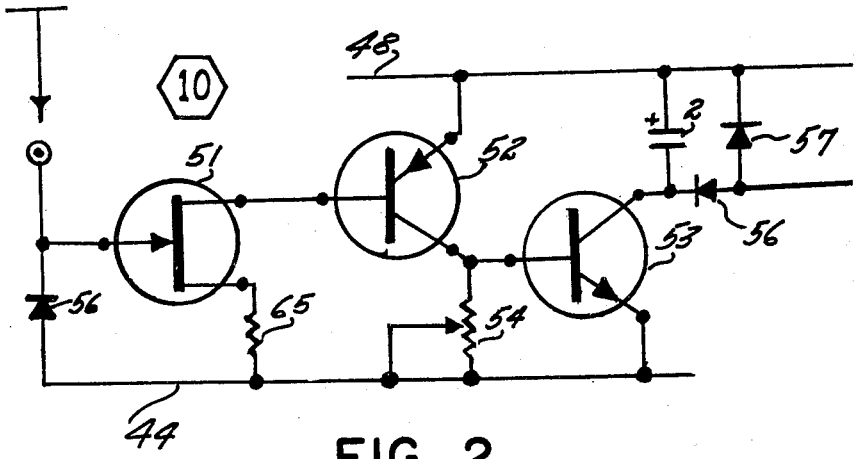
FIGS. 2, 3, 4, 5, 6, 7, 8 and 9 are enlarged detail views of circuit element parts of the package illustrated in FIG. 1.
Figure 3:
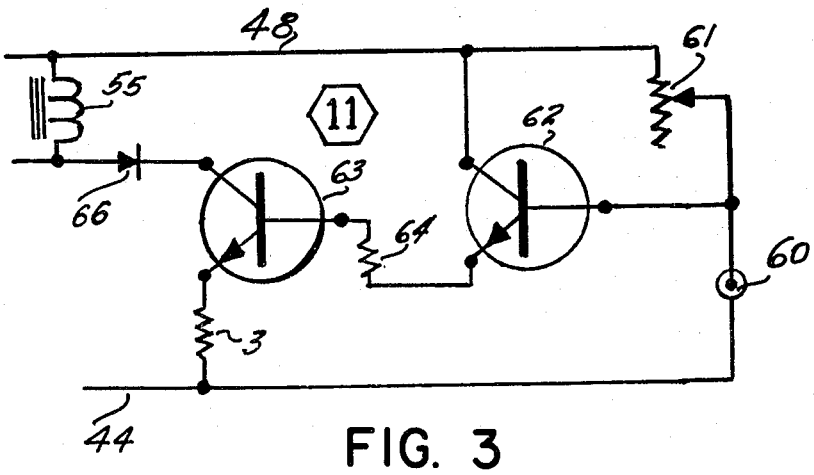

Referring now to the drawing for one illustrative embodiment of this invention, reference numeral 1 indicates the complete package, contained in a housing 126. The housing 126 is, in practice, compact, and has been made, with jack receptacles, adjusting knobs, test and operating lights, and meter, no longer than 9" long, 6" deep and 3" high.

The housing contains a power supply circuit 40A, seven sensor-amplifying circuits 10–16, a timing circuit 20, a test circuit 98 and an output circuit 135, with a terminal strip 128. Most of the components of the circuits are mounted on a perforated board 119.

The power supply circuit 40A includes terminals 30 for electrical connection to a source of alternating current, which, in the embodiment shown, is ordinary 110 volt, 60 hertz house current, an on-off switch 31, a power relay 32, and a 12 volt transformer 40. The arm of the power relay 32, which is energized when the switch 31 is closed, pulls in against a terminal 34. The arm of relay 32 is normally biased to the position shown in FIG. 1, in contact with a terminal 35, connected to one side of a battery 136. Thus, when the switch 31 is open or the power from the AC source is cut off, the switch 33 automatically puts the battery 136 into the circuit.

Current from the secondary of the transformer 40 is rectified by means of a conventional full wave rectifying bridge 68. The anode junction of bridge 68 is connected to a common ground or minus 44, and the collector junction of the bridge 68, by way of a resistor 45, to the terminal 34, the AC power side of the arm of the relay 32, and to the positive terminal of a condensor 33.

In any event, power is supplied to a source conductor 48. A display lamp 38 indicates that power is being supplied to conductor 48.

The circuit 10, in this embodiment, is a touch or proximity circuit. By way of illustration, an antenna or touch plate 50 is shown, electrically connected to the gate of a field effect transistor 51, the drain of which is electrically connected to the base of a transistor 52 and the source of which is connected through a suitable resistor 65 to ground 44. The emitter of the transistor 52 is connected to the source 48, and its collector, to a variable resistor 54, to ground, and to the base of a transistor 53. The center terminal (sliding contact) of the variable resistor 54 and the low end terminal of the resistor 54 are both electrically connected to ground 44. The collector of the transistor 53 is electrically connected to the cathode of a diode 56 and to a capacitor 2. The anode of the diode 56 and the negative side of capacitor 2 are connected to the ground side of a relay 55. The positive side of capacitor 2 is electrically connected to the source conductor 48, as is the other side of the relay 55. In this embodiment, a diode 57 in parallel with the relay 55, serves to increase the response speed of the relay 55 and also prevents relay chattering and prolongs relay life, a very worthwhile feature.

It can be seen that when the transistor 53 is turned on, the relay is energized from the source conductor 48, to which the relay is electrically connected, to ground.

In this embodiment, the circuit 11 is shown as electrically connected to a conventional photocell intrusion detector 124, mounted on the front panel of the cabinet 126, through a jack receptacle 60 of the type that disconnects the photocell detector when a jack plug is inserted. Such a jack can be electrically connected to a different sensor that this circuit is adapted to accommodate, such as a rain detector 138, with a conventional interdigitated sensor element, the spaced conductors of which are bridged by drops of water when rain falls on it. The jack receptacle 60 is electrically connected to a variable resistor 61 and the base of a transistor 62. The collector of transistor 62 is connected to the source conductor 48, and its emitter, through a resistor 64, to the base of a transistor 63. The emitter of the transistor 63 is connected through a resistor 3 to ground, and its collector, to the cathode of a diode 66, the anode of which is connected to the grounding side of the relay 55. As in the circuit 10, the turning on of the transistor 63 energizes the relay 55.

Figure 4:
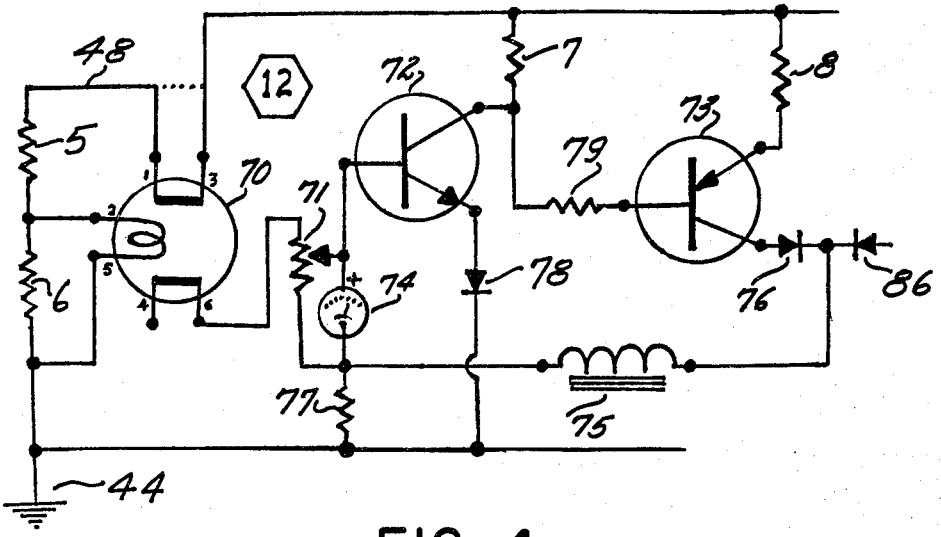
Figure 5:
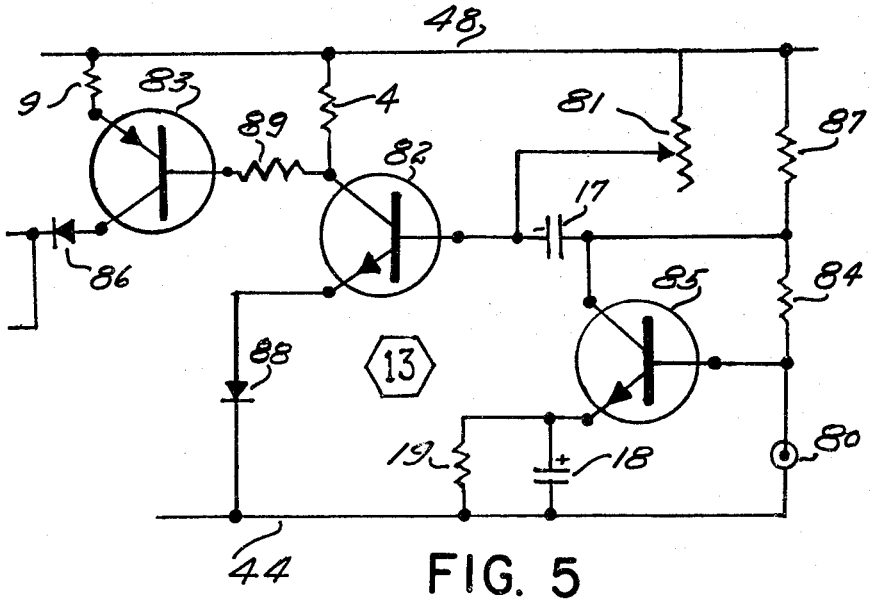
Figure 6:
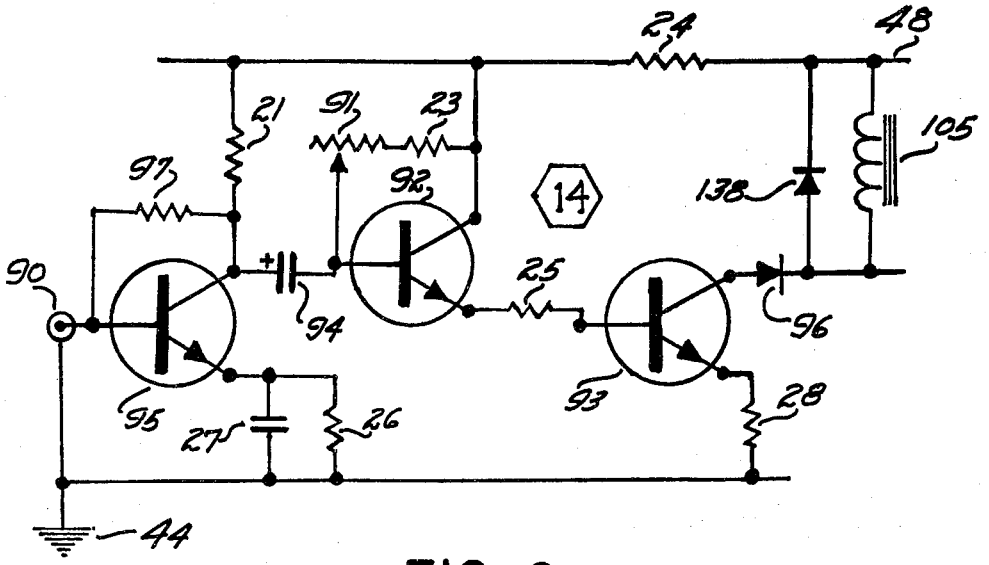
Figure 7:
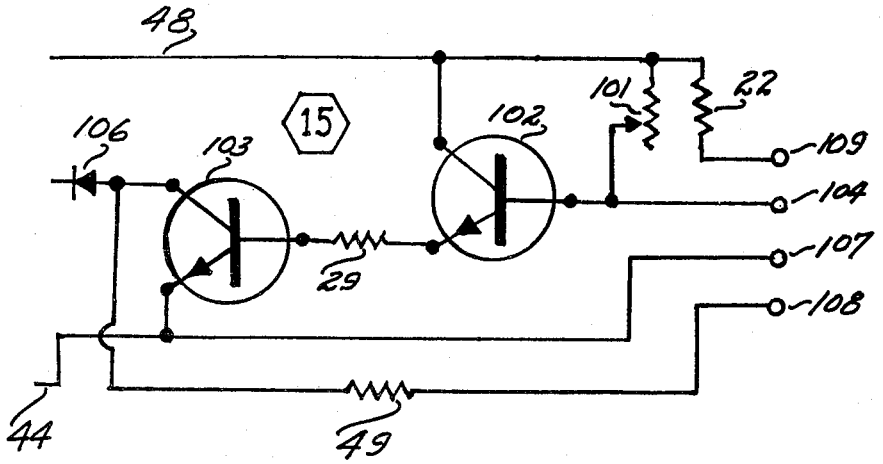
Figure 8:
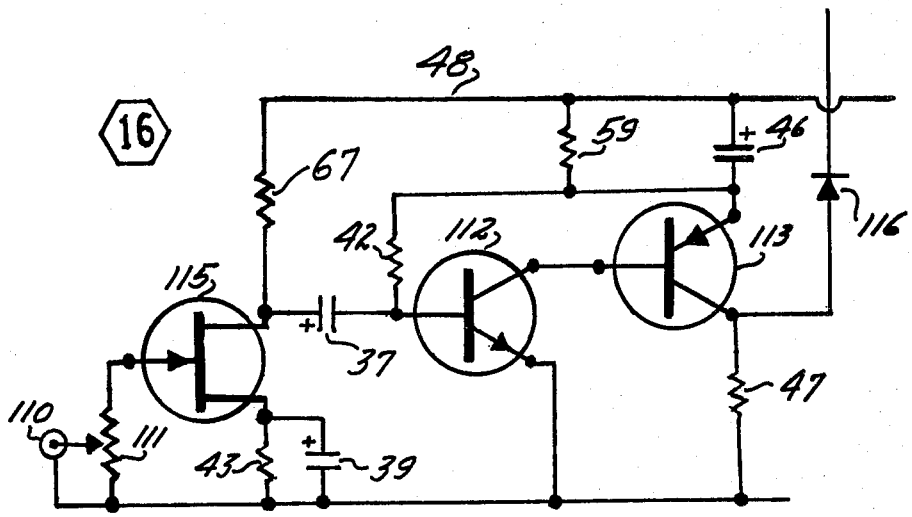
Figure 9:
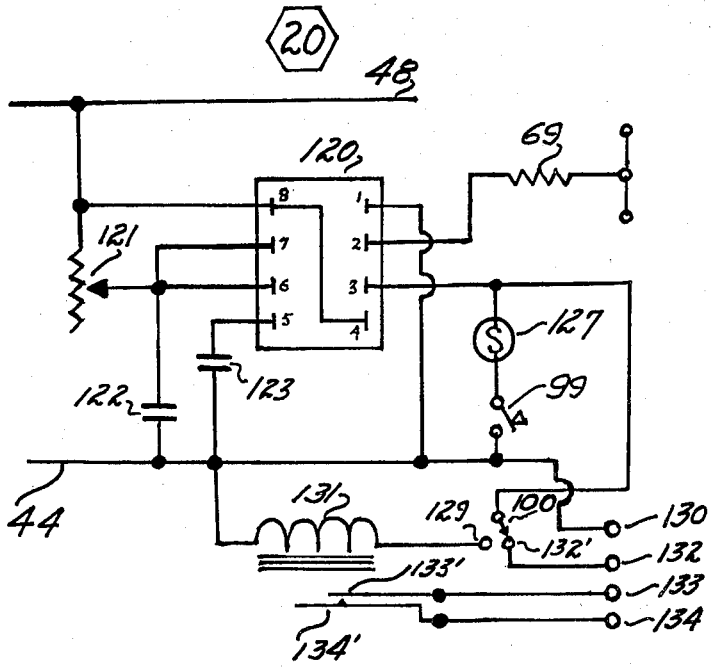
Figure 10:
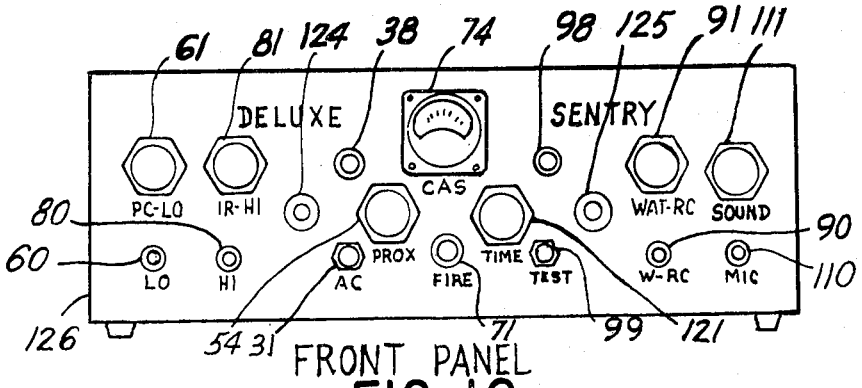
FIG. 10 is a view in front elevation of one embodiment of package of this invention.
Figure 11:
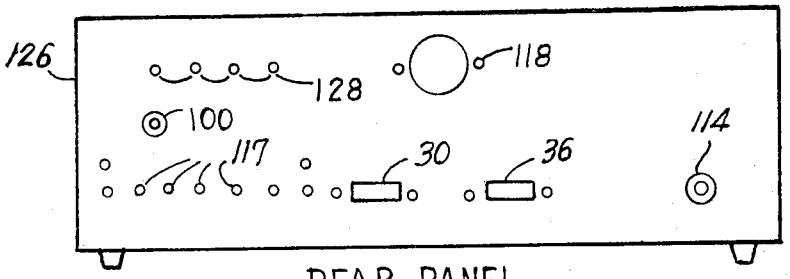
FIG. 11 is a view in rear elevation of the package of FIG. 10.
Figure 12:
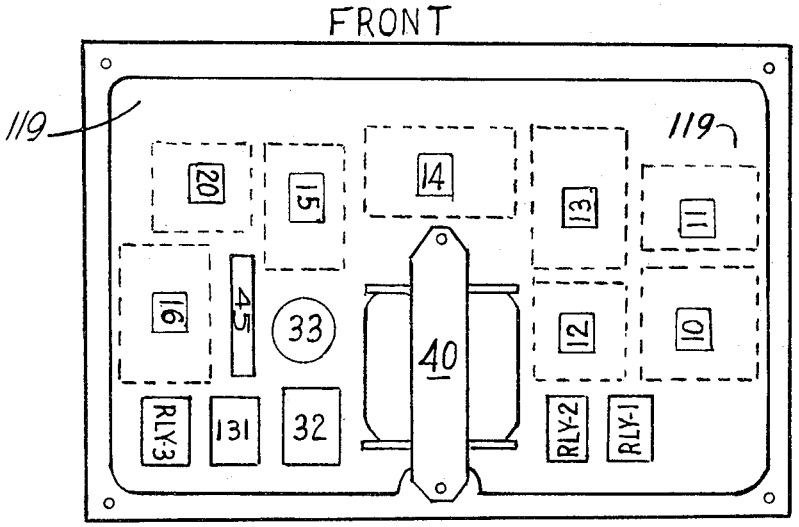
FIG. 12 is a bottom plan view of the package of FIGS. 10 and 11.
Figure 13:
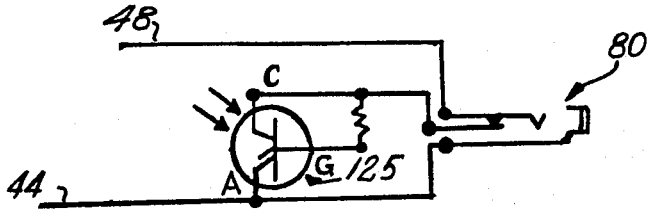
FIG. 13 is a somewhat diagrammatic view of an infrared sensor in the circuit of FIG. 1.
Figure 14:
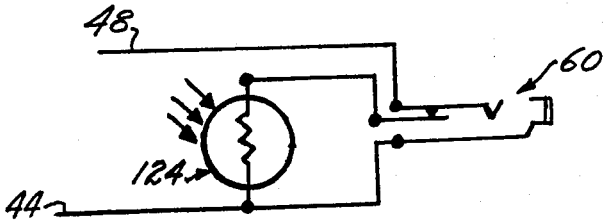
FIG. 14 is a somewhat diagrammatic view of a photocell intrusion detector in the circuit of FIG. 1.
Figure 15:
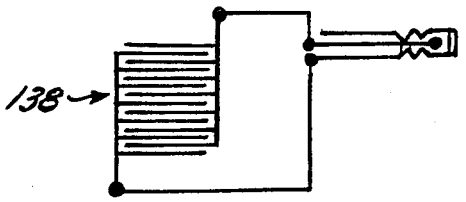
FIG. 15 is a somewhat diagrammatic view of a rain sensor adapted for use in the circuit of FIG. 1.

The circuit 12 of this embodiment is shown as a gas sensor circuit, with a gas sensor 70 of the Calectro type J4-807 that is commercially available. As shown particularly in FIG. 4, the gas sensor 70 has terminals 1–6. Terminals 1 and 3 are connected internally, and numbers 4 and 6 are also connected internally, as indicated. Terminal 1 is connected to the positive source conductor 48. Terminal 6 is connected to one side of a variable resistor 71 that is connected to one side of a meter 74, hence, by way of a resistor 77, to ground 44. Terminal number 6 of the sensor 70 is connected to the high side of variable resistor 71. This circuit gives high gain. The bottom terminal of variable resistor 71 is connected to the junction of resistor 77, meter 74, and a relay 75. The center terminal of the variable resistor 71 is connected to the base of a transistor 72, the collector of which is connected, through a resistor 7 to the source 48 and through a resistor 79, to the base of a transistor 73, the collector of which is connected to the anode side of a diode 76. The cathode side of the diode 76 is connected to the source side of the relay 75, the ground side of which is connected, through the resistor 77, to ground. The emitter of the transistor 72 is connected, through a diode 78, to ground, and the emitter of the transistor 73, through a resistor 8, to the source conductor 48. The emitter of transistor 72 and a diode 78, connected to the ground in this configuration, tend to form a faster triggering of the circuit along with transistor 77 between ground and variable resistor 71 and relay 75. A 20 ohm 10 watt resistor 5 in series with a 3200 ohm 10 watt resistor 6 between ground 44 and the DC 12 volt (+) on conductor 48 furnishes 5 volts at their junction for sensor 70.

The circuit 13 is shown as an infrared circuit, with an infrared sensor 125, mounted on the front panel of the housing 126, connected to the circuit through a jack receptacle 80, one side of which is connected to ground 44, and the other side, to a resistor 84 and to the base of a transistor 85. The jack receptacle 80 is of the type to disconnect the infrared sensor from the circuit when a jack plug, electrically connected to a different sensor, is inserted. The collector of the transistor 85 is connected to the source conductor 48 between resistors 84 and 87. Its emitter is connected to ground through a resistor 19 and a capacitor 18 connected in parallel. The base of a transistor 82 is connected to the source conductor 48 through a variable resistor 81 and, between the resistors 84 and 87, through a capacitor 17. The emitter of the transistor 82 is connected to ground through a diode 88, and its collector, through a resistor 4 to the source conductor 48 and through a resistor 89, to the base of a transistor 83. The emitter of the transistor 83 is connected through a resistor 9 to the source 48, and its collector to the anode side of a diode 86, the cathode of which is connected to the source side of the relay 75. The circuit 13 is adapted to use with other sensors. For example, an AM radio can be plugged into the circuit, tuned above the broadcast range, to pick up electrical disturbances at a range of up to twenty miles, depending upon the sensitivity setting of the variable resistor 81.

The circuit 14 is shown as a remote control circuit. It includes a sensor, which can be almost any sort of switching device, responsive to a timer, a manually operated switch such as a selector switch, or a switch responsive to barometric pressure or electrostatic charges. The sensor is connected to the circuit through a jack 90 one side of which is connected to ground 44, and the other, to the base of a transistor 95, to a resistor 97, hence to the collector of a transistor 92, and, through resistors 21, 24 and 22, to a source terminal 109. The emitter of the transistor 95 is connected, through a resistor 26 and a capacitor 27 in parallel, to a ground terminal 107. The collector of the transistor 95 is connected, through a capacitor 94, to the base of a transistor 92, which is also connected through a variable resistor 91, series resistor 23 and resistors 24 and 22 to the source terminal 109, thus to source conductor 48. The collector of the transistor 92 is electrically connected to the source conductor 48, and the emitter, through a resistor 25, to the base of a transistor 93. The emitter of the transistor 93 is connected through a resistor 28 to the terminal 107, and its collector, to the anode side of a diode 96, the cathode side of which is connected to one side of a relay 105.

The circuit 15 is a normally open-normally closed switch circuit adapted to be connected to a foot pressure switch, window or door switch or the like. The circuit 15 includes a transistor 102 the base of which is connected to a terminal 104 and, through a variable resistor 101 to ground, the collector of which is connected to ground, and the emitter of which is connected, through a resistor 29, to a base of a transistor 103. The collector of the transistor 103 is connected to the cathode of a diode 106, and the emitter, to terminal 107. The anode of the diode 106 is connected to the same side of the relay 105 as is the diode 96. The cathode of the diode 106 is also connected, through a resistor 49, to a terminal 108. The source terminal 109 is connected to source 48.

When terminals 104 and 107 are connected by normally closed alarm switches, the circuit 15 is adapted to use with as many normally closed switches as needed but all must be connected in series. When the terminals 108 and 109 are connected to normally open switches, the circuit 14 is adapted to use with as many normally open switches as needed, but all switches must be connected in parallel. Both normally open and normally closed switches can be used in the circuit at the same time. A jumper strip 137 connects terminals 104 and 107 if only normally open switches are being used.

In the present embodiment, circuit 16 is a sound sensing circuit, with a sound sensing microphone, preferably a ceramic 250 Kohm impedance microphone, connected by means of a jack 110 on one side to ground 44, and on the other, through a variable resistor 111, to the gate of a field effect transistor 115 the drain of which is connected through a resistor 67 to source 48 and through a condensor 37 to the base of a transistor 112, and the source of which is connected through a resistor 43 and a capacitor 39 in parallel, to ground 44. The collector of the transistor 112 is connected to the base of a transistor 113 the collector of which is connected through a resistor 47 to ground, and to the cathode of a diode 116 the anode of which is connected to the source side of relay 105. The emitter of the transistor 113 is connected, in parallel with a resistor 42 from the base of the transistor 112, through a resistor 59 and a capacitor 46 in parallel with one another, to the source conductor 48. The base of the transistor 112 is also connected, by way of a resistor 41, to ground.

Each of the relays 55, 75, and 105 operates a switch to trigger a timer 120. The timer 120 in circuit 20 can be of the type known as an IC 555. The terminals of the timer 120 are numbered conventionally, but with a prime. 1' is ground, 2' the trigger, to which the relay switches are connected, 3' the output, 4' the reset, 5' the control voltage, connected to ground through a capacitor 123, 6' the threshold, 7' the discharge, and 8' the supply voltage, which is connected to the source conductor 48. The duration of the timing cycle is controlled by a variable resistor 121, and a capacitor 122. This is conventional. The timer cycle can range from two seconds to five minutes, or the operation of the device can be made continuous.

The test circuit 98 in this embodiment consists of a test lamp 127 connected to the output terminal 3', and a switch 99 one side of which is connected to ground and the other to the test lamp 127.

The output terminal 3' is connected to a switch 100. The switch 100, in the embodiment shown, is a single pole, double throw switch, alternatively connected to a contact 129 (high) and a contact 132' (low) of the output circuit 128. When the switch 100 is connected to contact 129, contacts 134' and 133' provide high amperage output, because when a relay 131 is energized, the contact 133' is pulled into contact with contact 134' which is connected by way of its corresponding terminal 134 to a source of relatively high current, e.g., 12 to 120 volt AC from a house current source. When the switch 100 is electrically connected to contact 132', the output of the timer 120 is available at terminal 132, and a signal or control device requiring only a small amount of current can be connected between terminal 132 and ground terminal 130. The contact 129 is connected to the source end of the relay 131, the other end of which is connected to ground 44.

In either case, the signal device can be of any desired type, such as a siren, bell, or light. The control device can be a telephone dialing device, a switching device for turning on or off appliances, or raising or lowering windows. These are merely illustrative.

As will be apparent to those skilled in the art, the variable resistors in the different circuits permit adjustment of the sensitivity of the circuits to signals from the sensor. It is to be noted that each of the circuits is provided with such a sensitivity adjustment. These adjustments are useful not only to accommodate different sensors, but to change the performance characteristics of a single sensor. For example, a proximity sensor can be used as a contact sensor by reducing the gain. The threshold of a smoke detector can be raised or lowered. These are merely illustrative. The variable resistors are mounted so that an adjusting knob or the like is accessible from the outside of the housing, generally on a front panel. The meter 74 of the circuit 12, and the display and test lamps are also preferably mounted on the front panel, as are jack receptacles for the sensors or controls.

Simply as an illustration of the character and values of one embodiment of package of this invention, the elements that have been identified can be as follows:

2. 10 mfd. 35 v. PC electrolytic condensor
3. 15 ohm ¼ watt resistor
4. 33K ¼ watt resistor
5. 20 ohm 10 watt wire wound resistor
6. 3200 ohm 10 watt resistor
7. 33 Kohm ¼ watt resistor
8. 10 ohm ¼ watt resistor
9. 10 ohm ¼ watt resistor
17. 1 mfd. 35 volt electrolytic condensor
18. 10 mfd. 35 volt electrolytic condensor
19. 680 ohm ¼ watt resistor
21. 40 Kohm ¼ watt resistor
22. 22 ohm ½ watt resistor
23. 470 ohm ¼ watt resistor
24. 560 ohm ½ watt resistor
25. 560 ohm ¼ watt resistor
26. 680 ohm ¼ watt resistor
27. 10 mfd. 35 volt electrolytic condensor
28. 10 ohm ¼ watt resistor
29. 15 ohm ¼ watt resistor
30. 110 volt red panel socket, 2 pin
31. Sub-min 110 volt 10 amp toggle switch
32. 110 volt 10 amp DPDT 5000 ohm relay
33. 1000 mfd. 35 volt PC electrolytic condensor
34. Relay switch contacts #32 relay
35. Battery contacts #32 relay
36. 12 volt white panel socket, 2 pin
37. 4.7 mfd. 35 volt PC electrolytic condensor
38. Dial bulb socket, red glass
39. 4.7 mfd. 35 volt PC electrolytic condensor
40. XFMR 110 volt AC 12 volt 3 amp sec.
41. 33 Kohms ¼ watt resistor
42. 470 Kohms ¼ watt resistor
43. 47 Kohms ¼ watt resistor
45. 12 ohm 10 watt wire resistor
46. 4.7 mfd. 35 volt PC electrolytic condensor
47. 10 Kohm ½ watt resistor
49. 1000 Ohm ½ watt resistor
51. N-FET, RS-2028 or equal
52. 276-2022 PNP transistor or equal
53. 276-2038 NPN transistor or equal
54. 100 Kohm linear taper pot.
55. Min. 12 volt 1200 ohm, 10 ma. relay
56. 1N914/4148 switching diode
57. 1N914/4148 switching diode
58. 1N914/4148 switching diode
59. 100 Kohm ¼ watt resistor
60. Miniature jack, L0-input
61. 100 Kohm, linear taper potentiometer
62. 276-2031 NPN transistor or equal
63. 276-2038 NPN transistor or equal
64. 22 ohm ¼ watt resistor
65. 1 megohm ¼ watt resistor
66. 1N914/4148 switching diode
67. 100 Kohm ¼ watt resistor
68. Full wave 50 volt 6 amp bridge rectifier
69. 4700 ohm ¼ watt resistor
70. J4-807 Calectro gas sensor
71. 100 Kohm, linear taper potentiometer
72. 2N2010 NPN transistor or equal
73. 2N1305, 276-2007 PNP transistor
74. DC milameter, 0–1 or 0–5 ma.
75. Min. 12 volt 1200 ohm, 10 ma. relay
76. 1N914/4148 switching diode
77. 5 ohm 5 watt wire resistor
78. 1N34 crystal diode
79. 470 ohm ¼ watt resistor
80. Miniature jack, IR-HI input
81. 50K linear taper potentiometer
82. 276-2031 NPN transistor or equal
83. 2N1305, 276-2007 PNP transistor
84. 220 Kohm ¼ watt resistor

85. 276-2031 NPN transistor or equal
86. 1N914/4148 switching diode
87. 10 Kohm ¼ watt resistor
88. 1N34 crystal diode
89. 470 ohm ¼ watt resistor
90. Miniature jack, HI-IMP input
91. 50 Kohm linear potentiometer
92. 276-2031 NPN transistor or equal
93. 276-2038 NPN transistor or equal
94. 3 mfd. 35 volt PC electrolytic condensor
95. 276-2010 NPN transistor or equal
96. 1N914/4148 switching diode
97. 220 Kohm ¼ watt resistor
99. Miniature momentary SPST test switch
100. SPDT toggle output switch
101. 470K linear taper potentiometer
102. 276-2033 NPN transistor or equal
103. 276-2038 NPN transistor or equal
104. NC lug on 4-screw terminal strip
105. Min. 12 volt 1200 ohm 10 ma. relay
106. 1N914/4148 switching diode
107. NC lug on 4-screw terminal strip
108. NO lug on 4-screw terminal strip
109. NO lug on 4-screw terminal strip
110. Miniature jack microphone input
111. 500K linear taper potentiometer
112. 276/2010 NPN transistor or equal
113. 2N1305 276-2007 PNP transistor
114. Phone tip socket for prox. sensor
115. RS-2028 N-FET transistor or equal
116. 1N914/4148 switching diode
117. 4-screw terminal strip for NO-NC
118. 7 pin miniature socket for 70
119. 6″×8″ IC perf. board, 100×100, 3/16″
121. 1 megohm linear potentiometer
122. 100 mfd. 35 volt tantalum or equal
123. 0.01 50 volt disc ceramic condensor
126. 6″×9″×3″ cabinet
127. 12 volt dial bulb (test lamp)
128. 4-screw terminal strip for output
129. High amp terminal of output switch
130. Ground, common lug on 4 terminal strip
131. 12 volt DC DPDT 3 amp relay
132. Low terminal of output switch
133. Low output terminal strip lug
134. High output terminal strip lug
136. Battery 12 volt
137. Jumper strip between 104 and 107
138. 1N914/4148 switching diode Numerous variations in the construction of the device of this invention, within the scope of the appended claims, will occur to those skilled in the art in the light of the foregoing disclosure. Merely by way of example, the function of the three relays can be performed by triacs or silicon controlled rectifiers, but the relay has the advantage of automatically resetting and reliability. The circuit 10 can be used for safety functions, as in the operation of a punch press, and circuit 15 can be used to pick up and respond to machine vibrations. These are merely illustrative.

I claim:

1. An electronic sensor package comprising at least six sensor-amplifier circuits each adapted to be electrically connected to a different condition responsive device and each electrically connected directly to a relay for energizing said relay, each of said relays being electrically connected to at least two of said sensor-amplifier circuits whereby the number of relays to which said sensor-amplifier circuits are connected is no more than half the number of sensor-amplifier circuits, said relays being electrically connected to a timing circuit electrically connected to signal or control means, or both.

2. The package of claim 1 wherein said condition responsive devices include a gas sensor, a proximity type intrusion detector, a photosensitive fire detector, an ionization type smoke detector, a weather detector, and a sound sensor.

3. The package of claim 2 wherein each of said sensor-amplifier circuits includes means for varying the sensitivity of said sensor-amplifier circuits.

4. The package of claim 1 including a portable housing having front, side and rear panels and an infrared sensor and a photocell intrusion detector mounted in a panel of said housing.

5. The package of claim 4 wherein said infrared sensor and photocell intrusion detector are electrically connected in sensor-amplifier circuits through jack receptacles adapted to receive jack plugs connected to different sensors and to disconnect said infrared sensor and photocell intrusion detector upon insertion of said jack plugs.

* * * * *